US009046835B2

(12) United States Patent
Takeuchi et al.

(10) Patent No.: US 9,046,835 B2
(45) Date of Patent: Jun. 2, 2015

(54) IMAGE FORMING APPARATUS

(71) Applicants: Kenji Takeuchi, Nagoya (JP); Kei Ishida, Nagoya (JP); Kaoru Suzuki, Ichinomiya (JP); Yuki Fukusada, Kasugai (JP)

(72) Inventors: Kenji Takeuchi, Nagoya (JP); Kei Ishida, Nagoya (JP); Kaoru Suzuki, Ichinomiya (JP); Yuki Fukusada, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 59 days.

(21) Appl. No.: 13/762,531

(22) Filed: Feb. 8, 2013

(65) Prior Publication Data

US 2013/0202325 A1 Aug. 8, 2013

(30) Foreign Application Priority Data

Feb. 8, 2012 (JP) ..... 2012-025072

(51) Int. Cl.
*G03G 15/20* (2006.01)
*G03G 15/00* (2006.01)

(52) U.S. Cl.
CPC ..... *G03G 15/2039* (2013.01); *G03G 15/2046* (2013.01); *G03G 15/657* (2013.01); *G03G 2215/2035* (2013.01)

(58) Field of Classification Search
USPC ..... 399/69, 70
See application file for complete search history.

(56) References Cited

U.S. PATENT DOCUMENTS

| | | | | |
|---|---|---|---|---|
| 4,937,600 | A * | 6/1990 | Hirabayashi et al. | 347/156 |
| 7,965,955 | B2 * | 6/2011 | Takahashi et al. | 399/69 |
| 8,301,051 | B2 * | 10/2012 | Ogiso et al. | 399/69 |
| 2011/0135334 | A1 * | 6/2011 | Sato | 399/69 |
| 2011/0274450 | A1 * | 11/2011 | Atarashi | 399/37 |
| 2011/0274453 | A1 | 11/2011 | Shimokawa et al. | |
| 2011/0318039 | A1 * | 12/2011 | Watanabe | 399/69 |
| 2012/0163848 | A1 * | 6/2012 | Okano et al. | 399/69 |

FOREIGN PATENT DOCUMENTS

| | | | | |
|---|---|---|---|---|
| JP | 59111669 | A * | 6/1984 | G03G 15/20 |
| JP | 2011-237495 | A | 11/2011 | |

* cited by examiner

*Primary Examiner* — David Gray
*Assistant Examiner* — Sevan A Aydin
(74) *Attorney, Agent, or Firm* — Banner & Witcoff, Ltd.

(57) ABSTRACT

An image forming apparatus includes: a fixing device having a heat source, a heating member, and a backup member; a temperature detecting member; a driving source configured to rotate at least one of the heating member and the backup member; a transmitting mechanism configured to transmit a driving force of the driving source; and a control device configured to control the heat source and the driving source, wherein, after a power is turned on, the control device turns on the heat source before the driving source is driven for the first time, and wherein, when at least one of a condition, where the temperature detected by the temperature detecting member becomes a first temperature, and a condition where a predetermined period elapses after the power is turned on, is satisfied, the control device turns off the heat source and then drives the driving source.

6 Claims, 8 Drawing Sheets

IMAGE FORMING APPARATUS

CROSS-REFERENCE TO RELATED APPLICATION

This application claims priority from Japanese Patent Application No.2012-025072 filed on Feb. 8, 2012, the entire subject matter of which is incorporated herein by reference.

TECHNICAL FIELD

This disclosure relates to an image forming apparatus including a fixing device having a heat source, a driving source, and a transmitting mechanism for transmitting the driving force of the driving source to the fixing device.

BACKGROUND

As an electrophotographic image forming apparatus, it is known that an image forming apparatus includes a fixing device for thermally fixing a developer image transferred on a recording sheet, a driving source, and a transmitting mechanism for transmitting the driving force of the driving source to the fixing device.

Specifically, the fixing device includes a heat source, a nip member and a cylindrical member that are heated by the heat source, and a backup member that sandwiches the cylindrical member between the backup member and the nip member. Further, the backup member is configured to rotate by a driving force transmitted from the driving source through the transmitting mechanism, and the cylindrical member is configured to be driven to rotate depending on the backup member. In this fixing device, lubricant is provided between the nip member and the cylindrical member, so that it is possible to reduce friction occurring between the nip member and the cylindrical member.

SUMMARY

However, in the above-mentioned background art, when the image forming apparatus is powered on, the lubricant may be cooled to harden. In this case, if the driving source is driven, a load may be applied to the cylindrical member and may damage the cylindrical member. Also, in a case where lubricant is provided even in the transmitting mechanism, if the driving source is driven in a state where the lubricant has hardened, a load may be applied to the transmitting mechanism.

Accordingly, this disclosure provides at least an image forming apparatus capable of reducing a load on a fixing device or a transmitting mechanism when the driving source has been driven.

In view of the above, an image forming apparatus includes:a fixing device having, a heat source, a heating member configured to be heated by the heat source, and a backup member configured to sandwich a recording sheet between the backup member and the heating member; a temperature detecting member configured to detect the temperature of the heating member; a driving source configured to rotate at least one of the heating member and the backup member; a transmitting mechanism configured to transmit a driving force of the driving source to the at least one of the heating member and the backup member; and a control device configured to control the heat source and the driving source. A after a power is turned on, the control device turns on the heat source before the driving source is driven for the first time. When at least one of a condition, where the temperature detected by the temperature detecting member becomes a first temperature, and a condition where a predetermined period elapses after the power is turned on, is satisfied, the control device turns off the heat source and then drives the driving source.

According to the image forming apparatus configured as described above, before the driving source is driven, the heat source is turned on, so that the lubricant provided in the fixing device or the transmitting mechanism is heated to soften. Therefore, it is possible to reduce a load on the fixing device or the transmitting mechanism when the driving source has been driven.

According to this disclosure, it is possible to reduce a load on the fixing device or the transmitting mechanism when the driving source has been driven.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Now, an illustrative embodiment of this disclosure will be described in detail with reference to appropriate drawings. In the following description, the general configuration of a laser printer 1 will be first described in brief as an example of an image forming apparatus according to the illustrative embodiment of this disclosure, and then a fixing device and a control device will be described in detail.

Figure 1:
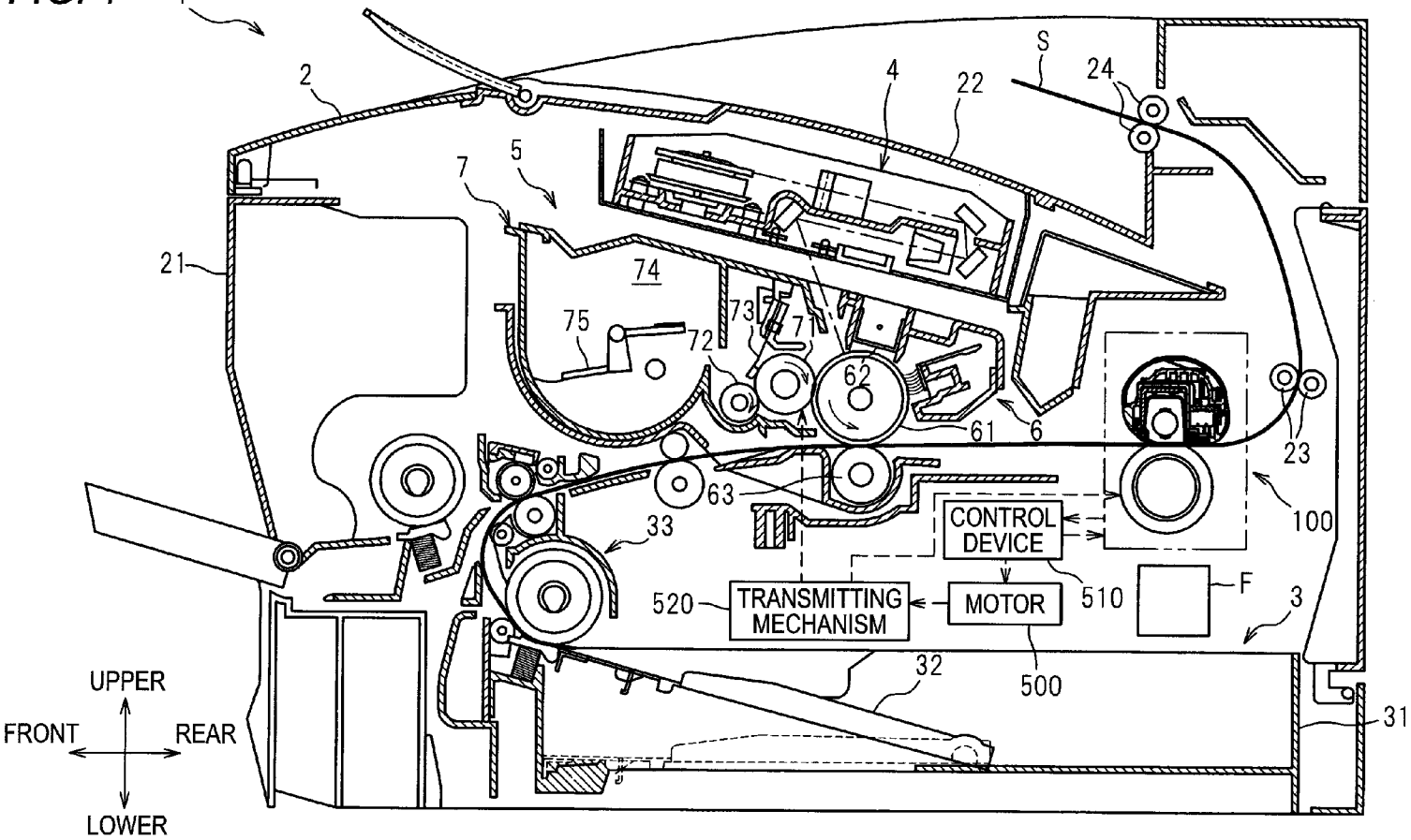
FIG. 1 is a view schematically illustrating the configuration of a laser printer according to an illustrative embodiment of this disclosure.

Also, in the following description, directions of the laser printer 1 refer to the directions as seen from a user facing to the laser printer during its use. To be more specific, referring to FIG. 1, a left-side direction and a right-side direction of the drawing sheet are referred to as a "front side" and a "rear side" of the laser printer, respectively. Also, a direction away from a viewer of FIG. 1 is referred to as a "left side", and a direction toward the viewer of FIG. 1 as a "right side". An upper and lower direction in FIG. 1 is referred to as an "upper-lower direction".

<General Configuration of Laser Printer>

As shown in FIG. 1, the laser printer 1 mainly includes a sheet feeding unit 3, an exposing device 4, a processing cartridge 5, and a fixing device 100 inside a main body casing 2.

The sheet feeding unit 3 feeds a sheet S as an example of a recording sheet, the processing cartridge 5 transfers a toner image (developer image) onto the sheet S, and the fixing device 100 thermally fixes the toner image onto the sheet S.

The main body casing 2 includes a fan F for discharging air in the main body casing 2 to the outside of the main body casing 2. The fan F is configured to start to rotate if the power of the laser printer 1 is turned on and to continue to rotate at least from when print is completed to when the detected temperature of the center thermistor 400C to be described below becomes equal to or lower than a predetermined temperature.

The sheet feeding unit 3 is provided at the lower portion of the inside of the main body casing 2, and mainly includes a sheet feed tray 31, a sheet pressing plate 32, and a sheet feeding mechanism 33. Sheets S stored in the sheet feed tray 31 are pulled upward by the sheet pressing plate 32, and are fed toward the processing cartridge 5 (between a photosensitive drum 61 and a transfer roller 63) by the sheet feeding mechanism 33.

The exposing device 4 is disposed at the upper portion of the inside of the main body casing 2, and includes a laser-beam emitting unit (not shown), a polygon mirror, lenses, and so on (reference symbol not provided). In the exposing unit 4, a laser beam (see a chain line) based on image data is emitted from the laser emission unit, and thus the laser beam is irradiated onto a surface of the photosensitive drum 61 to scan the surface of the photosensitive drum 61 at high speed, so that the surface of the photosensitive drum 61 is exposed.

The process cartridge 5 is disposed below the exposing unit 4, and it is configured to be attachable and detachable with respect to the main body casing 2 from an opening shown when a front cover 21 provided to the main body casing 2 is open. The process cartridge 5 is configured by a drum unit 6 and a developing unit 7.

The drum unit 6 mainly includes the photosensitive drum 61, a charger 62, and a transfer roller 63. Also, the developing unit 7 is configured to be attachable and detachable with respect to the drum unit 6, and mainly includes a developing roller 71, a feeding roller 72, a layer-thickness regulating blade 73, a toner container 74 for containing toner (developer), and an agitator 75 for agitating the toner in the toner container 74.

In the process cartridge 5, the surface of the photosensitive drum 61 is uniformly charged by the charger 62, and then is exposed by high-speed scanning with the laser beam from the exposing unit 4, so that an electrostatic latent image based on the image data is formed on the photosensitive drum 61. Further, the toner in the toner container 74 is supplied to the developing roller 71 through the feeding roller 72, and enters into a gap between the developing roller 71 and the layer-thickness regulating blade 73, so as to be held as a thin layer having a constant thickness on the developing roller 71.

The toner held on the developing roller 71 is supplied from the developing roller 71 to the electrostatic latent image formed on the photosensitive drum 61. Therefore, the electrostatic latent image is visualized, that is, a toner image is formed on the photosensitive drum 61. Then, a sheet S is conveyed between the photosensitive drum 61 and the transfer roller 63, so that the toner image on the photosensitive drum 61 is transferred onto the sheet S.

The fixing device 100 is provided on the rear side relative to the process cartridge 5. The transferred toner image (toner) transferred on the sheet S passes through the fixing device 100, so that the toner image is fixed on the sheet S by heat. Then, the sheet S is discharged onto a sheet discharge tray 22 by conveyance rollers 23 and 24.

<Detailed Configuration of Fixing Device>

Figure 2:
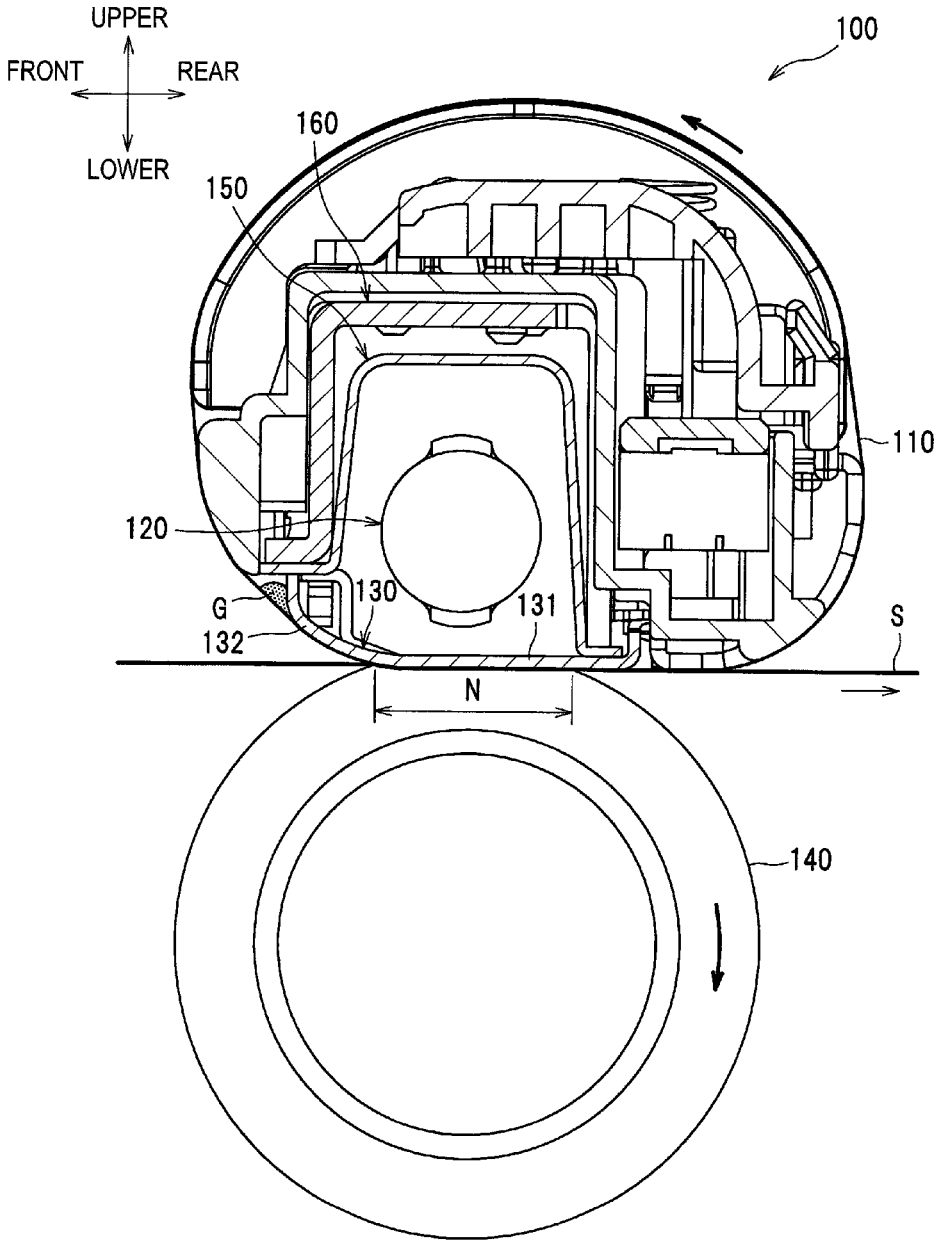
FIG. 2 is a cross-sectional view illustrating a fixing device.

As shown in FIG. 2, the fixing device 100 includes a nip plate 130 (nip member) and a fixing belt 110 (cylindrical member) as an example of a heating member, a halogen lamp 120 as an example of a heat source, a pressing roller 140 as an example of a backup member, a reflective plate 150, and a stay 160.

The fixing belt 110 is an endless (cylindrical) belt made of stainless steel and having heat resistance and flexibility. Inside the fixing belt 110, the halogen lamp 120, the nip plate 130, the reflective plate 150, and the stay 160 are provided.

The halogen lamp 120 is a member which emits radiant heat to heat the nip plate 130 and the fixing belt 110 (a nip portion N), thereby heating the toner on the sheet S. The halogen lamp 120 is disposed with a predetermined gap from the inner surface of the nip plate 130.

The nip plate 130 is a plate-shaped member which receives the radiant heat from the halogen lamp 120, and it is disposed such that the lower surface of the nip plate 130 is in sliding contact with the inner circumferential surface of the fixing belt 110. In the present illustrative embodiment, the nip plate 130 is made of a metal. For example, the nip plate 130 is formed by bending an aluminum plate having heat conductivity higher than that of the stay 160 made of steel (to be described below). In the case of making the nip plate 130 of aluminum, it is possible to improve the heat conductivity of the nip plate 130.

Figure 3:
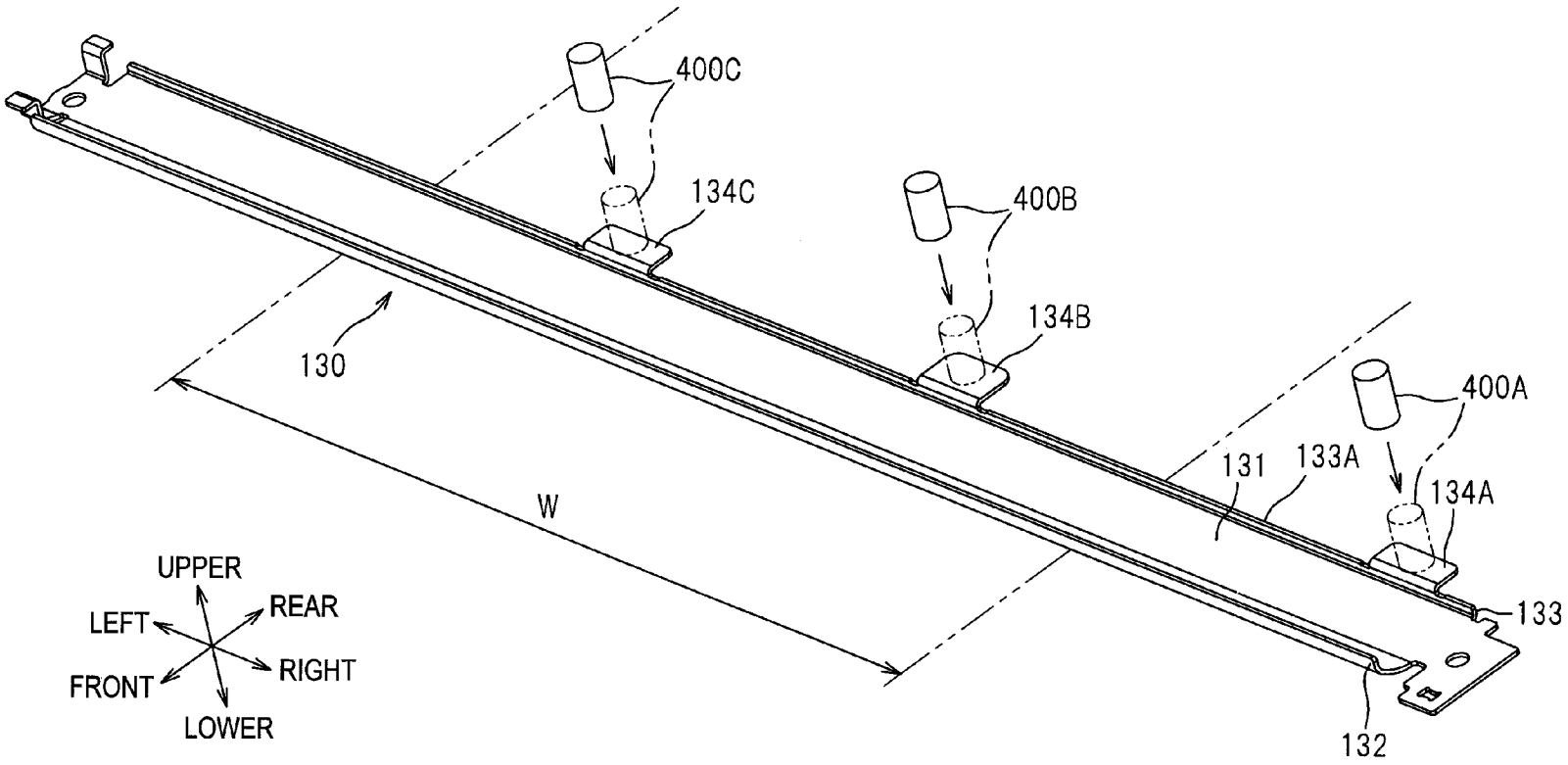
FIG. 3 is a perspective view illustrating a nip plate, a side thermistor, a thermistor, and a center thermistor.

As shown in FIGS. 2 and 3, the nip plate 130 includes a plate-like portion 131, a front bent portion 132, a rear bent portion 133, and three detection target portions 134A, 134B, and 134C.

The plate-like portion 131 is an elongated plate-like member which is perpendicular to a upper-lower direction and is long in a left-right direction, and the fixing belt 110 is sandwiched between the plate-like portion 131 and the pressing roller 140 in the upper-lower direction, so that the nip portion N is formed between the plate-like portion 131 and the fixing belt 110. Further, the plate-like portion 131 is disposed below the halogen lamp 120, and it is configured to transfer heat from the halogen lamp 120 to the toner on the sheet S through the fixing belt 110.

Also, on the inner surface (upper surface) of the plate-like portion 131, painting may be performed in black, or a heat absorbing member may be provided. In this case, it is possible to efficiently absorb the radiant heat from the halogen lamp 120.

The front bent portion 132 is formed to be bent in an almost arc shape upward from the front end side (upstream side in a predetermined direction) of the plate-like portion 131 to be disposed to face the halogen lamp 120. Therefore, the front bent portion 132 is directly heated by the halogen lamp 120. As a result, it is possible to heat (preheat) the sheet S having not entered the nip portion N, in advance, by the front bent portion 132, so that it is possible to improve a thermally fixing characteristic.

The rear bent portion 133 is formed to extend from the rear end edge of the plate-like portion 131 toward the upper side (the radially inner side of the fixing belt 110). Specifically, the rear bent portion 133 is formed to extend from one end side of the rear end edge of the plate-like portion 131 to the other end side in the left-right direction. Therefore, it is possible to use the rear bent portion 133 to effectively suppress lubricant G attached to the inner circumferential surface of the fixing belt 110 from flowing onto the upper surface of the plate-like portion 131 (for example, a surface painted in black). As a result, it is possible to suppress a reduction in the heating efficiency of the nip plate 130.

The three detection target portions 134A, 134B, and 134C are portions whose temperatures are detected by a side thermistor 400A, a thermostat 400B, and a center thermistor 400C, respectively. The three detection target portions 134A, 134B, and 134C are formed to extend from portions of the upper end edge 133A of the rear bent portion 133 toward the rear side. Specifically, two detection target portions 134B and 134C are disposed almost at the center portion of the rear bent portion 133 extending in the left-right direction, and one detection target portion 134A is disposed at one end portion on the outer side of the rear bent portion 133 in the left-right direction.

Also, as shown in FIG. 3, the detection target portions 134B and 134C, which is two of a left side of the detection target portions 134A, 134B, and 134C, are disposed inside a minimum sheet passage range W in the left-right direction, and the detection target portion 134A is disposed outside the minimum sheet passage range W in the left-right direction. Here, the minimum sheet passage range W indicates a passage range of sheet S having the minimum width in the left-right direction, within sheet S which can be used in the laser printer 1.

Here, the side thermistor 400A and the center thermistor 400C are temperature sensors for transmitting detected temperatures to a control device 510, and the thermostat 400B is provided to the detection target portions 134B at the center and is a thermal switch for mechanically cutting electricity to the halogen lamp 120 if a detected temperature exceeds a predetermined temperature.

Additionally, the side thermistor 400A may be a contact type thermistor for coming into contact with the detection target portion 134A at the right side so as to detect the temperature of the detection target portion 134A, or may be a non-contact type thermistor for detecting the temperature of the detection target portion 134A without coming into contact with the detection target portion 134A. Similarly, the center thermistor 400C may be a contact type thermistor for coming into contact with the detection target portion 134C at the left side so as to detect the temperature of the detection target portion 134C, or may be a non-contact type thermistor for detecting the temperature of the detection target portion 134C without coming into contact with the detection target portion 134C.

The detection result of the side thermistor 400A and center thermistor 400C is output to the control device 310.

As shown in FIG.2, the pressing roller 140 is a member to sandwich the fixing belt 110 between the pressing roller 140 and the nip plate 130, thereby forming the nip portion N between the pressing roller 140 and the fixing belt 110, and it is disposed below the nip plate 130. Further, in order to form the nip portion N, one of the nip plate 130 and the pressing roller 140 is biased toward the other. Furthermore, the pressing roller 140 is configured to rotate by a driving force transmitted from a motor 500 as an example of a driving source (see FIG. 1) provided inside the main body casing 2, and it is configured to rotate together with the fixing belt 110 in a state where the fixing belt 110 and the sheet S are sandwiched between the pressing roller 140 and the nip plate 130, thereby conveying the sheet S toward the rear side.

The reflective plate 150 is a member which reflects the radiant heat from the halogen lamp 120 toward the nip plate 130, and it is disposed inside the fixing belt 110 so as to surround the halogen lamp 120 with predetermined gaps from the halogen lamp 120. The reflective plate 140 is formed by bending, for example, an aluminum plate having high reflectivity for infrared rays and far infrared rays, almost in a U shape in a cross-sectional view.

The stay 160 is a member which supports the nip plate 130 through the reflective plate 150 and receives a load from the pressing roller 140 to surround the halogen lamp 120 and the reflective plate 150 inside the fixing belt 110. Here, it is assumed that the load is corresponding to a reaction force to the force of the nip plate 130 biasing the pressing roller 140 in the configuration where the nip plate 130 biases the pressing roller 140. This stay 160 is formed by bending a material having relatively high rigidity, for example, a steel plate.

The halogen lamp 120, a motor 500 for driving the pressing roller 140, and the like of the fixing device 100 configured as described above is configured to be controlled by the control device 510 shown in FIG. 1. Also, the motor 500 is provided inside the main body casing 2 and is configured not only to supply a driving force to the pressing roller 140 through a transmitting mechanism 520 having a plurality of gears (not shown) but also to supply driving forces to the developing roller 71, the feeding roller 72, and the agitator 75 through the transmitting mechanism 520. In other words, if the motor 500 is driven, the pressing roller 140, the developing roller 71, the feeding roller 72, and the agitator 75 are rotated at the same time.

Also, when the motor 500 is driven, the photosensitive drum 61 is charged by the charging unit 62. Therefore, in a case where the motor 500 is driven when it is not time for image forming, it is possible to prevent toner carried on the developing roller 71 from moving onto the photosensitive drum 61.

<Control Device>

The control device 510 is configured to include a CPU, a RAM, a ROM, and so on, and perform control on the halogen lamp 120 and the motor 500 based on an input signal from the center thermistor 400C which is an example of a temperature detecting member during an initial operation performed from when the power of the laser printer 1 is turned on to when print control starts.

Specifically, the control device 510 is configured to control the halogen lamp 120 to be turned on after the power of the laser printer 1 is turned on before the motor 500 is driven for the first time and to control the halogen lamp 120 to be tuned off if one condition of a condition, where the detected temperature T of the center thermistor 400C becomes a first temperature $T_C$, and a condition, where a predetermined period $t_C$ elapses from when the laser printer 1 is powered on, is satisfied and then drive the motor 500.

Also, the control device 510 is configured to restrict driving of the motor 500 for a predetermined time $t_1$ from when the power of the laser printer 1 is turned on. The predetermined time $t_1$ is a period necessary to sufficiently perform ventilation in the main body casing 2 by the fan F. Restricting driving of the motor 500 for the predetermined time $t_1$ as described above is because it is not desirable to turn on the charging unit 62 at the same time as driving of the motor 500 as described above in a state where ventilation in the main body casing 2 is insufficient, for example, in a state where combustible gases or the like remain. In the present illustrative embodiment, the predetermined time $t_1$ is set to be shorter than the predetermined period $t_C$.

Figure 4:
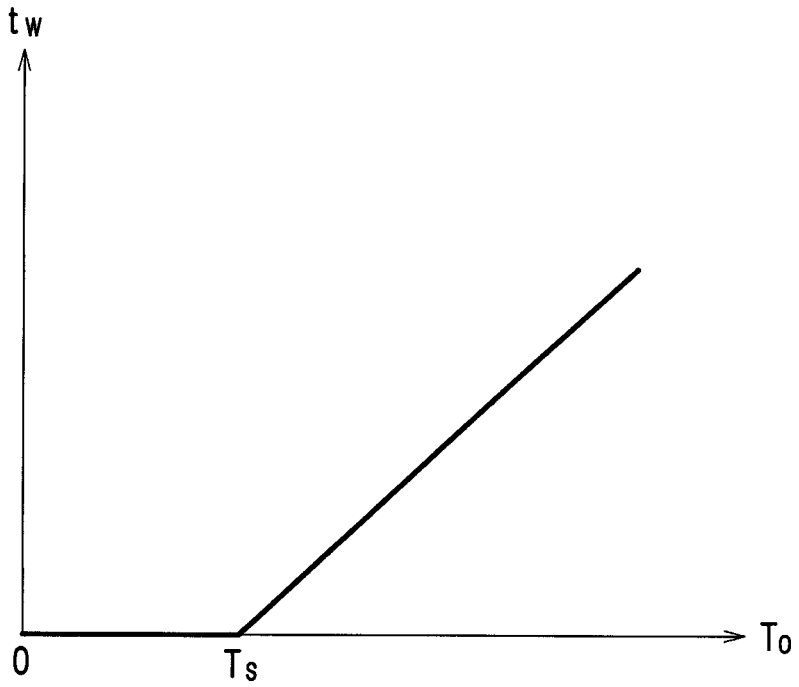
FIG. 4 is a view illustrating an example of a map representing the relation between an initial temperature and a waiting period.

Also, the control device 510 stores a map representing the relation between an initial temperature and a waiting period as shown in FIG. 4. Further, the control device 510 is configured to determine a waiting period $t_W$ from when the laser printer 1 has been powered on to when the halogen lamp 120 is turned on, based on the map and an initial temperature $T_0$ detected by the center thermistor 400C when the power of the laser printer 1 has been turned on.

In the map representing the relation between the initial temperature and the waiting period, when the initial temperature $T_0$ detected by the center thermistor 400C when the power of the laser printer 1 is turned on is lower than a second temperature $T_S$, the waiting period $t_W$ from when the power has been turned on to when the halogen lamp 120 is turned on is set to 0. Meanwhile, when the initial temperature $T_0$ is higher than the second temperature $T_S$, the waiting period $t_W$ is set to a value larger than 0. More specifically, in the map representing the relation between the initial temperature and the waiting period, when the initial temperature $T_0$ is higher than the second temperature $T_S$, the waiting period $t_W$ is set to be longer as the initial temperature $T_0$ increases. Specifically, experiments or the like is performed in advance, and then the waiting period $t_W$ is set such that a timing when the detected temperature T becomes the first temperature $T_C$ is after the predetermined time $t_1$ from when the power of the laser printer 1 has been turned on.

Further, the control device 510 is configured to maintain the halogen lamp 120 in the OFF state from when the halogen lamp 120 has been turned off to when the motor 500 is driven.

Figure 5:
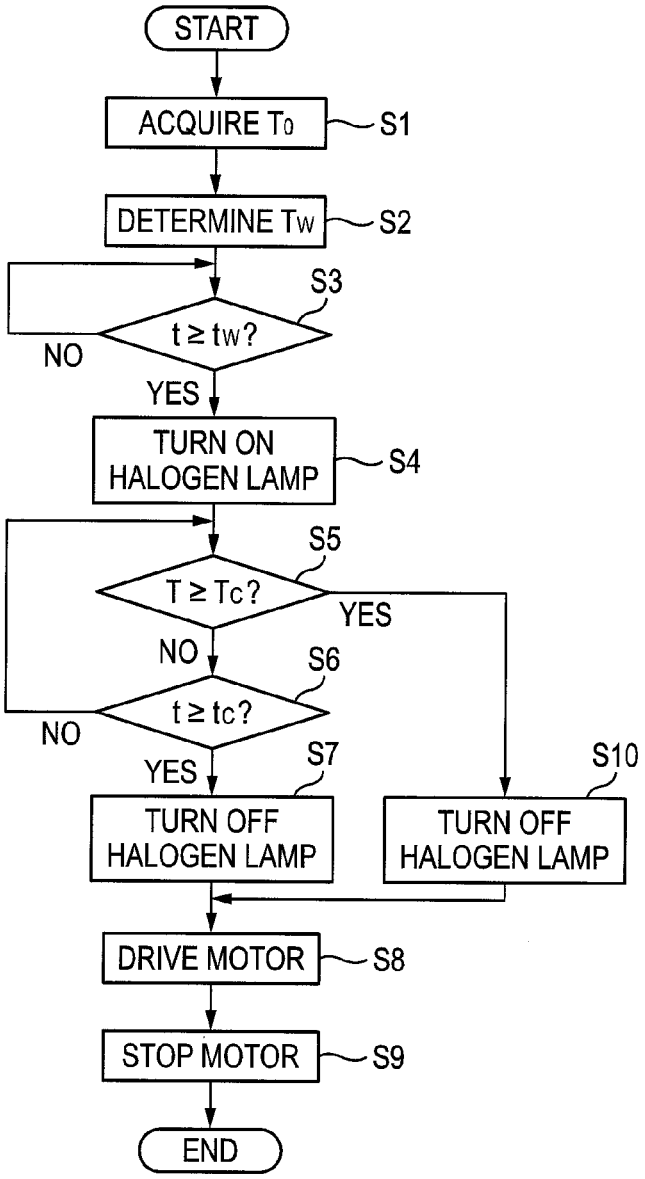
FIG. 5 is a flow chart illustrating control on a halogen lamp and a motor by a control device.

Subsequently, the control operation of the control device 510 will be described with reference to FIG. 5.

If the power of the laser printer 1 is turned on (START), first, the control device 510 acquires the initial temperature $T_0$ from the center thermistor 400C (step S1). Then, the control device 510 determines the waiting period $t_W$ until the halogen lamp 120 is turned on, with reference to the map representing the relation between the initial temperature and the waiting period (step S2).

Then, the control device 510 determines whether an elapsed time t after the power of the laser printer 1 has been turned on has become equal to or greater than the waiting period $t_W$ (step S3).

In a case where the elapsed time t is equal to or greater than the waiting period $t_W$ in step S3 (Yes), the control device 510 turns on the halogen lamp 120 (step S4). Meanwhile, in a case where the elapsed time t is less than the waiting period $t_W$ in step S3 (No), the control device 510 returns to step S3.

Figure 6:
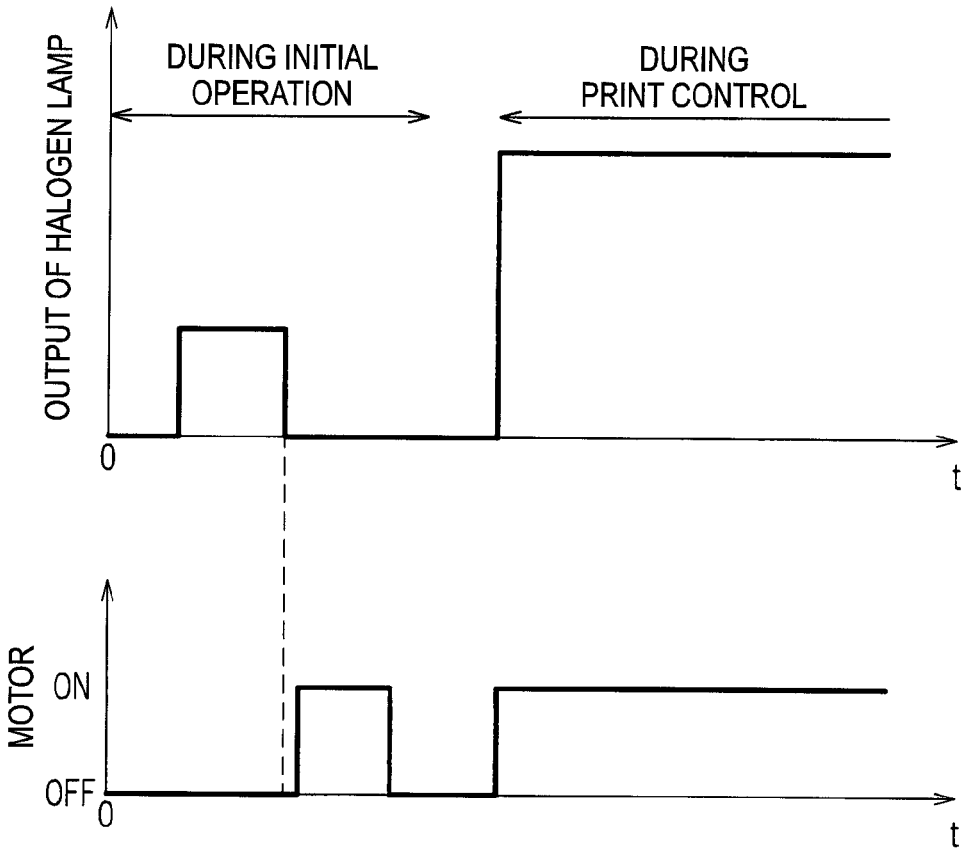
FIG. 6 is a view illustrating the output of the halogen lamp and driving or stop of the motor during an initial operation and during print control.

Here, as shown in FIG. 6, the output of the halogen lamp 120 in a case where the halogen lamp 120 has been turned on in step S4, in other words, the output of the halogen lamp 120 from when the power of the laser printer 1 has been turned on to when the motor 500 is driven for the first time is set to be smaller than the maximum output of the halogen lamp 120 which is turned on after the motor 500 is driven. Also, in FIG. 6, for the sake of convenience, the output of the halogen lamp 120 during print control is shown to be constant. However, actually, the output of the halogen lamp 120 appropriately changes.

Referring to FIG. 5 again, after the halogen lamp 120 is turned on in step S4, the control device 510 determines whether the detected temperature T of the center thermistor 400C is equal to or higher than the first temperature $T_C$ (step S5).

In a case where the detected temperature T is equal to or higher than the first temperature $T_C$ in step S5 (Yes), the control device 510 turns off the halogen lamp 120 (step S10).

Meanwhile, in a case where the detected temperature T is lower than the first temperature $T_C$ in step S5 (No), the control device 510 determines whether the elapsed time t after the power of the laser printer 1 has been turned on is equal to or greater than the predetermined period $t_C$ (step S6).

In a case where the elapsed time t is equal to or greater than the predetermined period $t_C$ in step S6 (Yes), the control device 510 turns off the halogen lamp 120 (step S7).

Meanwhile, in a case where the elapsed time t is less than the predetermined period $t_C$ in step S6 (No), the control device 510 returns to step S5.

After step S10 or step S7, the control device 510 drives the motor 500 (step S8). Specifically, when the elapsed time t is equal to or greater than the predetermined time $t_1$, the control device 510 drives the motor 500 immediately after the halogen lamp 120 is turned off. The term "immediately after the halogen lamp 120 is turning off" refers to, for example, 0.5 sec or less after the halogen lamp 120 is turned off.

After step S8, the control device 510 stops the motor 500 (step S9), and terminates control in the initial operation. Thereafter, if a print instruction is input, the control device 510 turns on the halogen lamp 120 or drives the motor 500, and performs known print control.

Next, the operations of the halogen lamp 120 and the motor 500 and a change of the detected temperature T of the center thermistor 400C in a case where the above-mentioned control operation has been performed by the control device 510 will be described with reference to FIGS. 7 and 8.

Figure 7:
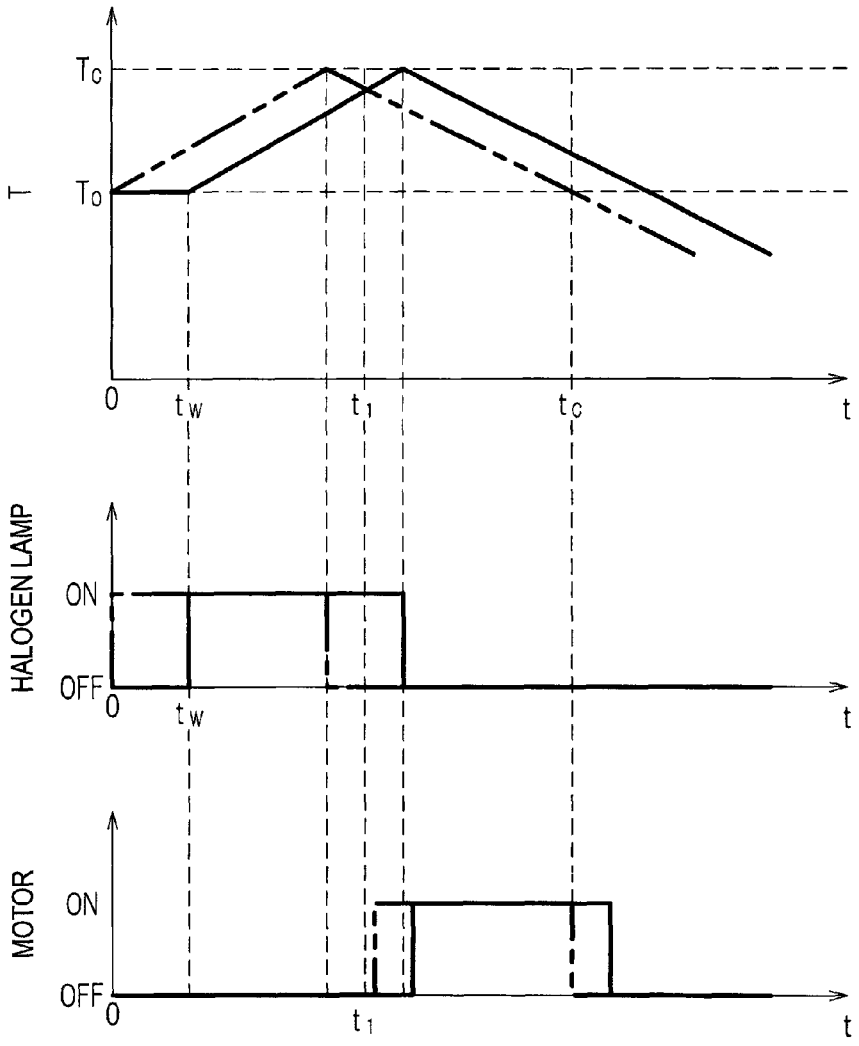
FIG. 7 is a view illustrating the relation between timings of ON/OFF of the halogen lamp and driving or stop of the motor, and the detected temperature of the center thermistor in a case where the initial temperature is high.

As shown in FIG. 7, in a case where the initial temperature $T_0$ is high, if the power of the laser printer 1 is turned on, after the waiting period $t_W$ elapses in a state where the motor 500 and the halogen lamp 120 is being stopped, the halogen lamp 120 is turned on (see a solid line). Therefore, the nip plate 130 is heated, so that the detected temperature T of the center thermistor 400C rises. Then, if the detected temperature T of the center thermistor 400C becomes the first temperature $T_C$, the halogen lamp 120 is turned off, and then the motor 500 is driven. As described above, in a case where the initial temperature $T_0$ is high, since there is the waiting period $t_W$ from when the power of the laser printer 1 has been turned on to when the halogen lamp 120 is turned on, the time point when the detected temperature T of the center thermistor 400C becomes the first temperature $T_C$ becomes later than the predetermined time $t_1$, and thus it is possible to drive the motor 500 immediately after the halogen lamp 120 is turned off.

In contrast, as shown by an alternate long and two short dashes line in FIG. 7, in a case where the waiting period $t_W$ is not set, if the elapsed time t when the detected temperature T of the center thermistor 400C has become the first temperature $T_C$ is less than the predetermined period t1, after the predetermined period t1 elapses, the motor 500 is driven. In other words, there is a vacant time from when the halogen lamp 120 has been turned off to when the motor 500 is driven. Therefore, the present illustrative embodiment shown by the solid line is more desirable than the form shown by the alternate long and two short dashs line.

Figure 8:
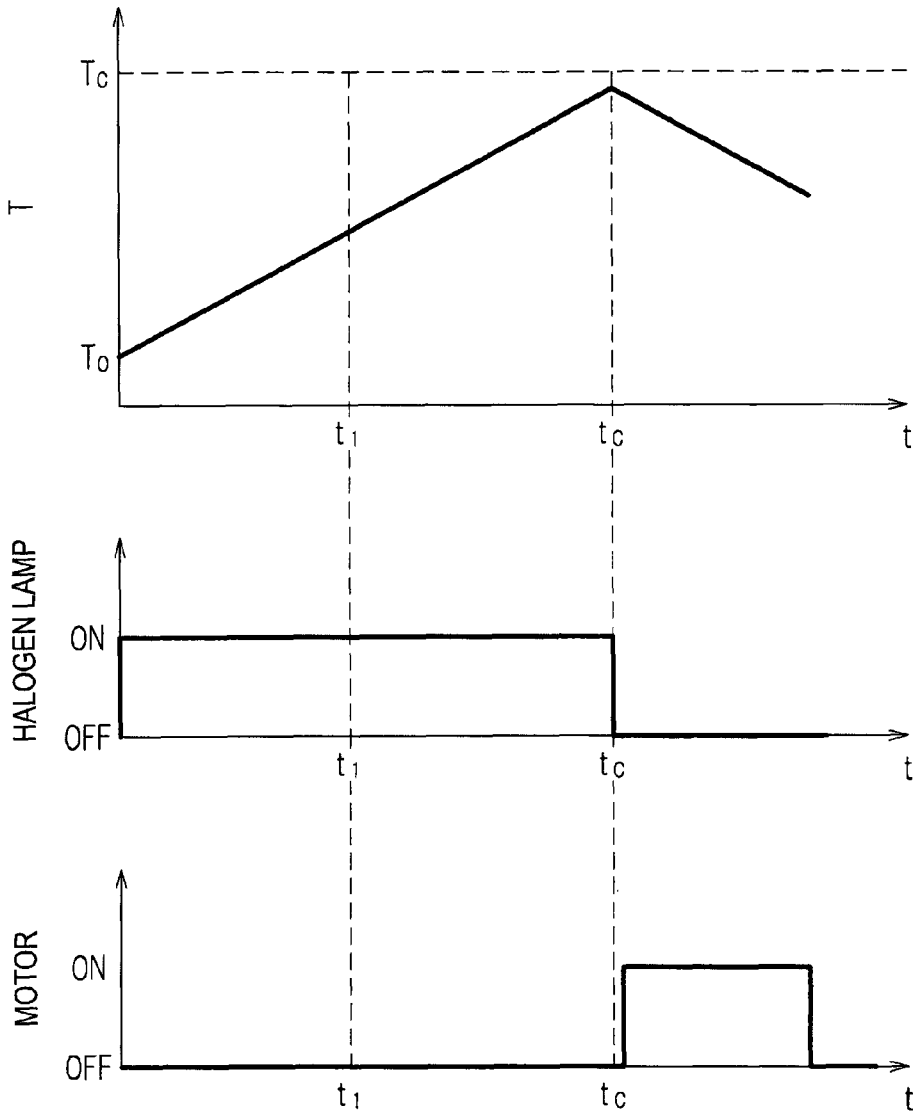
FIG. 8 is a view illustrating the relation between timings of ON/OFF of the halogen lamp and driving or stop of the motor, and the detected temperature of the center thermistor in a case where the initial temperature is low.

An example shown in FIG. 8 is, for example, a case where the power of the laser printer 1 has been turned on in a state of a low temperature than the example shown in FIG. 7. In this case, after the halogen lamp 120 is turned on, the predetermined period $t_C$ elapses while the detected temperature T of the center thermistor 400C does not become equal to or higher than the first temperature $T_C$. In this case, if the predetermined period $t_C$ elapses, the halogen lamp 120 is turned off, and then the motor 500 is driven.

According to the above-mentioned configuration, it is possible to obtain the following effects in the present illustrative embodiment.

After the power is turned on, before the motor 500 is driven for the first time, the halogen lamp 120 is turned on. Therefore, it is possible to heat the fixing device 100 and the transmitting mechanism 520 before the motor 500 is driven. As a result, the lubricant G provided in the fixing device 100 and the lubricant provided in the transmitting mechanism 520 are heated up to soften. Therefore, it is possible to reduce a load on the fixing device 100 or the transmitting mechanism 520 when the motor 500 is driven.

Also, since the timing to turn off the halogen lamp 120 is determined in view of not only the condition, where the detected temperature T of the center thermistor 400C becomes the first temperature $T_C$, but also the condition, where the elapsed time t becomes the predetermined period $t_C$, it is possible to terminate the initial operation in a short time as compared to a case where the timing to turn off the halogen lamp 120 is determined in view of only the condition, where the detected temperature T of the center thermistor 400C becomes the first temperature $T_C$.

Further, since the control device 510 drives the motor 500 immediately after the halogen lamp 120 is turned off, it is possible to drive the motor 500 immediately after the fixing device 100 and the transmitting mechanism 520 are heated up.

Also, after the power of the laser printer 1 is turned on, the output of the halogen lamp 120 before the motor 500 is driven for the first time is smaller than the maximum output of the halogen lamp 120 after the motor 500 is driven. Therefore, it is possible to prevent only the nip portion N of the fixing device 100 from becoming a high temperature, and obtain time to allow heat from the heat source to be transferred in a wide range.

Further, since the control device 510 sets the waiting period $t_W$ such that the timing when the detected temperature T of the center thermistor 400C becomes the first temperature $T_C$ becomes after the predetermined time $t_1$ from when the power of the laser printer 1 is turned on, it is possible to drive the motor 500 immediately after the fixing device 100 and the transmitting mechanism 520 are heated up.

Although the illustrative embodiment of this disclosure has been described, this disclosure is not limited thereto. The specific configuration can be appropriately changed within the scope of this disclosure.

In the above-mentioned illustrative embodiment, the control device 510 is configured to lengthen the waiting period $t_W$ as the initial temperature $T_0$ increases. However, this disclosure is not limited thereto. For example, the waiting period $t_W$ may be 0 when the initial temperature $T_0$ is equal to or lower than the second temperature $T_S$, and the waiting period may be a constant value regardless of the initial temperature $T_0$ when the initial temperature $T_0$ is higher than the second temperature $T_S$.

Even in this case, it is possible to reduce the time lag from when the halogen lamp 120 is turned off to when the motor 500 is driven, as compared to a case where the waiting period $t_W$ is not set.

Also, in the above-mentioned illustrative embodiment, the waiting period $t_W$ is set such that the timing when the detected temperature T becomes the first temperature $T_C$ becomes after the predetermined time $t_1$ from when the power of the laser printer 1 is turned on. However, this disclosure is not limited thereto. For example, it is possible to gradually lengthen the waiting period $t_W$ according to the initial temperature $T_0$ such that the timing when the detected temperature T becomes the first temperature $T_C$ becomes intermediately before the predetermined time $t_1$ from when the power of the laser printer 1 is turned on.

Even in this case, it is possible to reduce the time lag from when the halogen lamp 120 is turned off to when the motor 500 is driven, as compared to a case where the waiting period $t_W$ is not set.

Further, in the above-mentioned illustrative embodiment, the control device 510 have two of the condition, where the detected temperature T of the center thermistor 400C becomes the first temperature $T_C$ after the halogen lamp 120 is turned on, and the condition, where the predetermined period $t_C$ elapses after the power of the laser printer 1 is turned on, as conditions to turn off the halogen lamp 120. However, this disclosure is not limited thereto. The control device 510 may have only one of the two conditions as a condition to turn off the halogen lamp 120.

In the above-mentioned illustrative embodiment, as an example of the heat source, the halogen lamp 120 has been exemplified. However, this disclosure is not limited thereto. For example, the heat source may be a heat element, an IH heat source, or the like. Here, the IH heat source refers to a heat source which does not produce heat by itself, and but it makes a roller or a metal belt produce heat according to an electromagnetic-induction heating scheme.

In the above-mentioned illustrative embodiment, as an example of the heating member, the fixing belt 110 and the nip plate 130 have been exemplified. However, this disclosure is not limited thereto. For example, the heating member may be a heating roller which is a metal tube thicker than the fixing belt 110.

In the above-mentioned illustrative embodiment, the pressing roller 140 (the backup member) is rotated by the motor 500. However, this disclosure is not limited thereto. The motor needs only to rotate at least one of the backup member and the heating member. For example, in a case where the heating member is the above-mentioned heating roller, the heating roller may be driven by the motor.

In the above-mentioned illustrative embodiment, this disclosure has been applied to the laser printer 1. However, this disclosure is not limited thereto. This disclosure may be applied to other image forming apparatuses, for example, copy machines, multi-function apparatuses, and so on.

In the above-mentioned illustrative embodiment, as an example of the recording sheet, the sheets S such as thick sheet, card, and thin sheet have been used. However, this disclosure is not limited thereto. For example, the recording sheet may be an OHP sheet.

In the above-mentioned illustrative embodiment, as the backup member, the pressing roller 140 has been exemplified. However, this disclosure is not limited thereto. For example, the backup member may be a belt-like pressing member or the like.

In the above-mentioned illustrative embodiment, as the nip member, the nip plate 130 has been exemplified. However, this disclosure is not limited thereto. For example, the nip member may be a thick member which is not a plate shape.

Also, a control device for controlling the heat source and a control device for controlling the motor may be separate, and may be configured as one control device.

What is claimed is:

1. An image forming apparatus comprising:

a fixing device including:

heat source;

a heating member configured to be heated by the heat source; and a backup member configured to sandwich a recording sheet between the backup member and the heating member;

a temperature detecting member configured to detect the temperature of the heating member;

a driving source configured to rotate at least one of the heating member and the backup member;

a transmitting mechanism configured to transmit a driving force of the driving source to the at least one of the heating member and the backup member; and a control device configured to control the heat source and the driving source, wherein, after a power is turned on, the control device turns on the heat source before the driving source is driven for the first time and restricts driving of the driving source for a predetermined period, wherein, when at least one of a condition where the temperature detected by the temperature detecting member becomes a first temperature, and a condition where the predetermined period elapses after the power is turned on, is satisfied, the control device turns off the heat source and then drives the driving source, wherein, in a case where the temperature detected by the temperature detecting member when the power is turned on is higher than a second temperature, the control device waits for a predetermined waiting period after the power is turned on to turn on the heat source, and wherein the more the temperature detected by the temperature detecting member when the power is turned on increases, the more the control device lengthens the waiting period.

2. The image forming apparatus according to claim 1, wherein the control device drives the driving source immediately after the heat source is turned off.

3. The image forming apparatus according to claim 1, wherein the control device turns on the heat source after the driving source is driven, and wherein, output of the heat source before the driving source is driven for the first time is smaller than a maximum output of the heat source after the driving source is driven.

4. The image forming apparatus according to claim 1, wherein the heating member includes a nip member and a flexible cylindrical member;

wherein the cylindrical member is interposed between the backup member and the nip member;

wherein the backup member is rotated by the driving source, and wherein a lubricant is provided between the nip member and the cylindrical member.

5. The image forming apparatus according to claim 1, wherein the control device maintains the heat source in an OFF state from when the heat source is turned off to when the driving source is driven.

6. The image forming apparatus according to claim 1, wherein the heating member is a cylindrical belt.

* * * * *